US008280739B2

(12) United States Patent
Jiang et al.

(10) Patent No.: US 8,280,739 B2
(45) Date of Patent: Oct. 2, 2012

(54) METHOD AND APPARATUS FOR SPEECH ANALYSIS AND SYNTHESIS

(75) Inventors: Dan Ning Jiang, Beijing (CN); Fan Ping Meng, Beijing (CN); Yong Qin, Beijing (CN); Zhi Wei Shuang, Beijing (CN)

(73) Assignee: Nuance Communications, Inc., Burlington, MA (US)

( * ) Notice: Subject to any disclaimer, the term of this patent is extended or adjusted under 35 U.S.C. 154(b) by 764 days.

(21) Appl. No.: 12/061,645

(22) Filed: Apr. 3, 2008

(65) Prior Publication Data

US 2008/0288258 A1 Nov. 20, 2008

(30) Foreign Application Priority Data

Apr. 4, 2007 (CN) ..... 2007 1 0092294

(51) Int. Cl.
*G10L 13/00* (2006.01)

(52) U.S. Cl. ..... 704/261; 704/258; 704/259; 704/260

(58) Field of Classification Search ..... None
See application file for complete search history.

(56) References Cited

U.S. PATENT DOCUMENTS 5,729,694 A 3/1998 Holzrichter
6,125,344 A 9/2000 Kang
2001/0021905 A1 9/2001 Burnett
2004/0138879 A1* 7/2004 Kim ..... 704/219
2005/0114134 A1 5/2005 Deng

FOREIGN PATENT DOCUMENTS

EP 1347440 9/2003

OTHER PUBLICATIONS

Shiga, et al, "Estimation of Voice Source and Vocal Tract Characteristics Based on Multi-Frame Analysis", Eurospeech 2003, pp. 1749-1752.

D.H. Klatt et al., "Analysis, synthesis and perception of voice quality variations among female and male talkers", J.Acoust.Soc.Am., vol. 87, No. 2, pp. 820-857, 1990.

G. Fant et al., "A four-parameter model of glottal flow", STL-QPSR, Tech. Rep., 1985.

* cited by examiner

*Primary Examiner* — Leonard Saint Cyr
(74) *Attorney, Agent, or Firm* — Wolf, Greenfield & Sacks, P.C.

(57) ABSTRACT

The present invention provides a speech analysis method comprising steps of obtaining a speech signal and a corresponding DEGG/EGG signal; regarding the speech signal as the output of a vocal tract filter in a source-filter model taking the DEGG/EGG signal as the input; and estimating the features of the vocal tract filter from the speech signal as the output and the DEGG/EGG signal as the input, wherein the features of the vocal tract filter are expressed by the state vectors of the vocal tract filter at selected time points, and the step of estimating is performed using Kalman filtering.

8 Claims, 11 Drawing Sheets

METHOD AND APPARATUS FOR SPEECH ANALYSIS AND SYNTHESIS

TECHNICAL FIELD

The present invention relates to the fields of speech analysis and synthesis, and in particular to a method and apparatus for speech analysis using a DEGG/EGG (Differentiated Electroglottograph Electroglottograph) signal and Kalman filtering, and well as a method and apparatus for synthesizing speech using the results of the speech analysis.

BACKGROUND OF THE INVENTION

In the theory of speech generation, the following source-filter model is widely used:

$$s(t)=e(t)*f(t);$$

wherein, s(t) is the speech signal; e(t) is the glottal source excitation; f(t) is the system function of the vocal tract filter; t represents time; and * represents convolution.

FIG. 1 illustrates such a source-filter model for speech generation. As shown, the input signal from the glottal source is processed (filtered) by the vocal tract filter. At the same time, the vocal tract filter is disturbed, that is, the features (state) of the vocal tract filter varies over time. The output of the vocal tract filter is added with noise to produce the final speech signal.

In such a model, the speech signal is usually easy to be recorded. However, neither the glottal source or the features of the vocal tract filter can be detected directly. Thus, an important issue in speech analysis is, given a piece of speech, how to estimate both the glottal source and the vocal tract filter features.

This is a problem of blind deconvolution with no definite solutions, unless additional assumptions are introduced, such as a predefined parameterized model of the glottal source, and a model of a vocal tract filter. Predefined parameterized models of glottal source include Rosenberg-Klatt (RK) and Liljencrants-Fant (LF), for which reference can be made to D. H. Klatt & L. C. Klatt, "Analysis, synthesis and perception of voice quality variations among female and male talkers," J. Acoust. Soc. Am., vol. 87, no. 2, pp. 820-857, 1990, and G. Fant, J. Liljencrants & Q. Lin, "A four-parameter model of glottal flow," STL-QPSR, Tech. Rep., 1985, respectively. Models of vocal tract filter include LPC, i.e., an all-pole model, and a pole-zero model. The limitation of these model lies in that they are oversimplified with only a few parameters, and inconsistent with the situation of real signals.

That is to say, methods in prior art typically estimate both the glottal source and the vocal tract filter parameters, but since this is very difficult, in order to make the solution of the problem more definite, subjective assumptions have to be introduced, such as applying some approximate models to the glottal source, simplifying and reducing the order of the vocal tract filter, etc. All the subjective assumptions and processing will affect the accuracy or even correctness of the solution.

Moreover, in many actual application scenarios, speech signals are often ill-conditioned or under-sampled, which limits the application of current techniques, making them unable to extract full information from some piece of speech signal.

In addition, methods in prior art generally rely on the periodicity of speech signals, thus requiring the pitch marking of the fundamental period, that is, marking the start and stop points of each period. However, even if all pitch marking is performed manually, sometimes ambiguities will occur, thus affecting the correctness of the speech analysis.

Therefore, a need apparently exists in the field for a simpler, accurate, more efficient and robust speech analysis and synthesis method.

SUMMARY OF THE INVENTION

The problem intended to be solved by the present invention is to analyze a speech signal by performing source-filter separation on the speech signal, and at the same time to overcome the shortcomings of the prior art in this respect.

The method of the present invention utilizes DEGG/EGG signals, which can be measured directly, in lieu of the glottal source signal, thus reducing artificial assumptions, and making the results more authentic. At the same time, Kalman filtering and preferably a bidirectional Kalman filtering process is used to estimate the features of the vocal tract filter, that is, its state varying over time, from the DEGG/EGG signal and speech signal.

According to an aspect of the present invention, there is provided a method of speech analysis, comprising the following steps: obtaining a speech signal and a corresponding DEGG/EGG signal; regarding the speech signal as the output of a vocal tract filter in a source-filter model taking the DEGG/EGG signal as the input; and estimating the features of the vocal tract filter from the speech signal as the output and the DEGG/EGG signal as the input.

Preferably, the features of the vocal tract filter are expressed by the state vectors of the vocal tract filter at selected time points, and the step of estimating is performed using the Kalman filtering.

Preferably, the Kalman filtering is based on:

a state function $$x_k=x_{k-1}+d_k, \text{ and}$$

an observation function $$v_k=e_k^T x_k+n_k,$$

wherein, $x_k=[x_k(0), x_k(1), \ldots, x_k(N-1)]^T$ represents the state vector to be estimated of the vocal tract filter at time point k, wherein $x_k(0), x_k(1), \ldots, x_k(N-1)$ represent N samples of the expected unit impulse response of the vocal tract filter at time k;

$d_k=[d_k(0), d_k(1), \ldots, d_k(N-1)]^T$ represents the disturbance added to the state vector of the vocal tract filter at time k;

$e_k=[e_k, e_{k-1}, \ldots, e_{k-N+1}]^T$ is a vector, of which the element $e_k$ represents the DEGG signal inputted at time k;

$v_k$ represents the speech signal outputted at time k; and $n_k$ represents the observation noise added to the outputted speech signal at time k.

Preferably, the Kalman filtering is a two-way Kalman filtering comprising a forward Kalman filtering and a backward Kalman filtering, wherein, the forward Kalman filtering comprises the following steps:

forward estimation:

$$x_k^-=x_{k-1}^*,$$

$$P_k^-=P_{k-1}+Q$$

correction:

$$K_k=P_k^- e_k[e_k^T P_k^- e_k+r]^{-1}$$

$$x_k^*=x_k^-+K_k[v_k-e_k^T x_k^-]$$

$$P_k=[I-K_k e_k^T]P_k^-$$

forward recursion $$k=k+1;$$

the backward Kalman filtering comprises the following steps:

backward estimation:

$$x_k^-=x_{k+1}^*;$$

$$P_k^-=P_{k+1}+Q$$

correction:

$$K_k=P_k^- e_k[e_k^T P_k^- e_k+r]^{-1}$$

$$x_k^*=x_k^-+K_k[v_k-e_k^- x_k^-]$$

$$P_k=[I-K_k e_k^T]P_k^-$$

backward recursion $$k=k-1;$$

wherein, $x_k^{\sim}$ represents the pre-estimated state value at time point k, $x_k^*$ represents the corrected state value at time point k, $P_k^{\sim}$ represents the predicted value of the covariance matrix of the estimation error, $P_k$ represents the corrected value of the covariance matrix of the estimation error, Q represents the covariance matrix of disturbance $d_k$, $K_k$ represents the Kalman gain, r represents the variance of the observation noise $n_k$, I represents the unit matrix; and the estimation results of the two-way Kalman fitlelrare the combination of estimation results of the forward Kalman filter and the those of the backward Kalman filtering using the following formula:

$$P_k=(P_{k+}^{-1}+P_{k-}^{-1})^{-1},$$

$$x_k^*=P_k(P_{k+}^{-1}x_{k+}^*+P_{k-}^{-1}x_{k-}^*),$$

wherein, $P_{k+}$, $x_{k+}$ are the estimated state value of the vocal tract filter and the covariance of the state estimation obtained by the forward Kalman filtering respectively, and $P_{k-}$, $x_{k-}$ are the estimated state value of the vocal tract filter and the covariance of the state estimation obtained by the backward Kalman filtering respectively.

Preferably, the speech analysis method further comprises the following steps: selecting and recording the estimated state values of the vocal tract filter at selected time points obtained by the Kalman filtering, as the features of the vocal tract filter.

According to another aspect of the present invention, there is further provided a speech synthesis method, comprising the following steps: obtaining a DEGG/EGG signal; using the above-described speech analysis method to obtain the features of a vocal tract filter; and synthesizing the speech based on the DEGG/EGG signal and the obtained features of the vocal tract filter.

Preferably, the step of obtaining the DEGG/EGG signal comprises: reconstructing a full DEGG/EGG signal using a DEGG/EGG signal of a single period according to a give fundamental frequency and time length.

According to still another aspect of the present invention, there is provided a speech analysis apparatus, comprising: a module for obtaining a speech signal; a module for obtaining a corresponding DEGG/EGG signal; and an estimation module for, by regarding the speech signal as the output of a vocal tract filter in a source-filter model with the DEGG/EGG signal as the input, estimating the features of the vocal tract filter from the speech signal as the output and the DEGG/EGG signal as the input.

According to a further aspect of the present invention, there is provided a speech synthesis apparatus, comprising: a module for obtaining a DEGG/EGG signal; the above-described speech analysis apparatus; and a speech synthesis module for synthesizing a speech signal based on the DEGG/EGG signal obtained by the module for obtaining a DEGG/EGG signal and the features of the vocal tract filter estimated by the speech analysis apparatus.

The method and apparatus of the present invention have the following advantages:

It is simple, efficient, precise and robust;

It uses the DEGG/EGG signal which can be measured directly as the direct input of the vocal tract filter, no longer needing to estimate both the parameters of the vocal tract filter and the glottal source, thus overcoming the drawbacks in the prior art of having to take simplified model assumptions on the vocal tract filter and glottal source.

It provides a solution for analyzing speech in ill-conditioned or under-sampled situations. In an ill-conditioned or under-sampled actual application scenarios, the prior art cannot extract full information from a segment of a speech signal. The method of the present invention overcomes this difficulty.

No periodicity needs to be assumed. All the conventional speech analysis algorithms need to assume periodicity. In practice, however, this assumption is often incorrect. The method and apparatus of the present invention overcome this drawback in the prior art. Quasi-periodicity is no longer a problem.

It is not needed to mark the fundamental period, that is, to mark the start and stop points of each period. Fundamental period marking, even if wholly performed manually, sometimes leads to ambiguities. In the speech analysis process described herein, a DEGG signal is used as the input, speech signal as the output, and the filter parameters as the object to be estimated. Whether the signal is periodic is of no concern. Therefore, no period marking is needed.

While the vocal tract filter parameters are provided, the covariance matrix of the error is also provided at the same time, allowing the error of the estimated vocal tract filter parameters to be known.

The method and apparatus of the present invention can be further improved, such as by performing multi-frame combination, etc.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

In the following, embodiments of the present invention will be described with reference to the drawings, it being understood, however, that these embodiments are only presented for illustration and description, in order to enable those skilled in the art to understand the essential spirit of the present invention, and to practice the present invention, and are not intended to limit the present invention to the described embodiments. Therefore, it can be contemplated to practice the present invention using any combination of features and elements described hereinbelow, regardless of whether they relate to different embodiments. In addition, the numerous details described hereinbelow are only for the purposes of illustration and description, and should not be construed as limiting the present invention.

The present invention utilizes electroglottograph (EGG) signals to perform speech analysis. An EGG signal is a non-acoustic signal, which measures the variation of the electrical impedance at the larynx generated by the variation of the glottal contact area during the speech utterance of a speaker, and fairly accurately reflects the vibrations of the vocal cord. EGG signal together with acoustic speech signals are widely used in speech analysis and are mainly used for fundamental period marking and the detection of the fundamental pitch value, as well as for the detection of glottal events such as glottal openings and closings.

Figure 1:
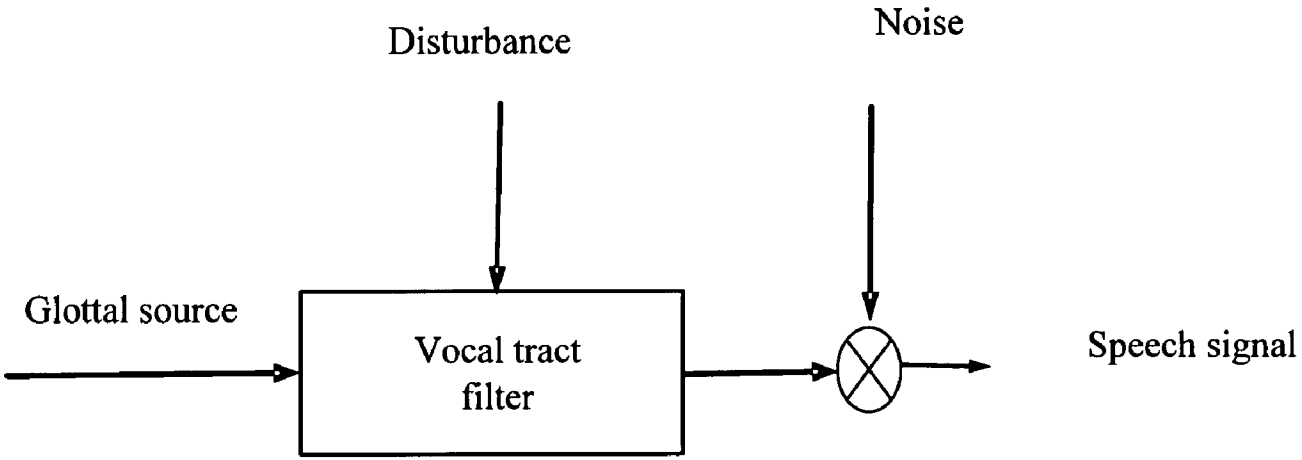
FIG. 1 illustrates a source-filter model about speech generation.
Figure 2:
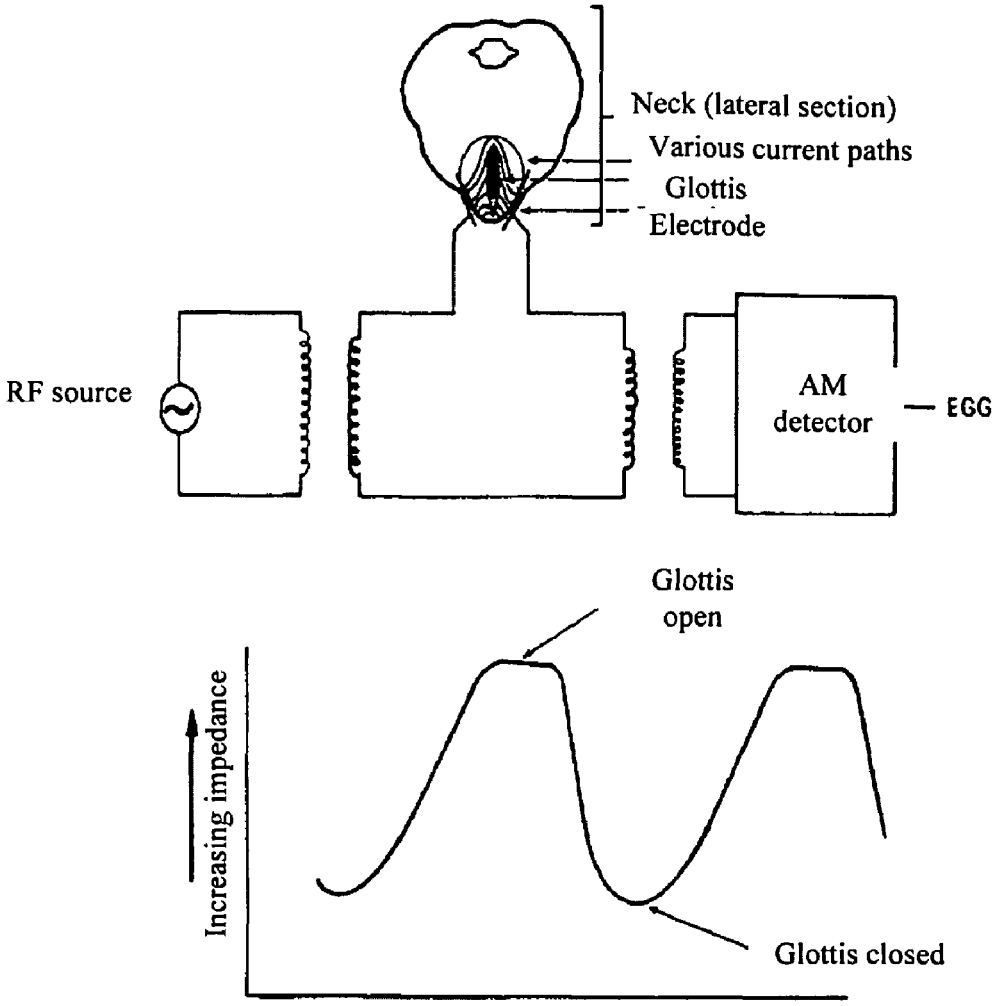
FIG. 2 illustrates a method of measuring EGG signals and an example of a measured EGG signal.

FIG. 2 illustrates the method of measuring EGG signals and an example of a measured EGG signal. As shown, a pair of plate electrodes is placed across the speaker's thyroid cartilage, and a small high frequency electricity is passed between the pair of electrodes. Because human tissue is a good electrical conductor, while air is not, during the speech utterance, the vocal folds (human tissue) are cut off by the glottis (air) at times. When the vocal folds are separated, the glottis is open, thus increasing the electrical impedance at the larynx. And when the vocal folds are closing, the size of the glottis is decreased, thus reducing the electrical impedance at the larynx. This variation of the electrical impedance causes the variation of the current in an electrode on one side, thus producing an EGG signal.

A DEGG signal is the differential in time of an EGG signal, and retains fully the information in the EGG signal, which can accurately reflect the vibrations of the glottis during the speaker's utterance.

A DEGG/EGG signal is not exactly the same as the glottal source signal, but the two are closely correlated. DEGG/EGG signals are easy to be measured, while glottal source signals are not. Therefore, DEGG/EGG signals can be used as substitutes for glottal source signals.

Figure 3:
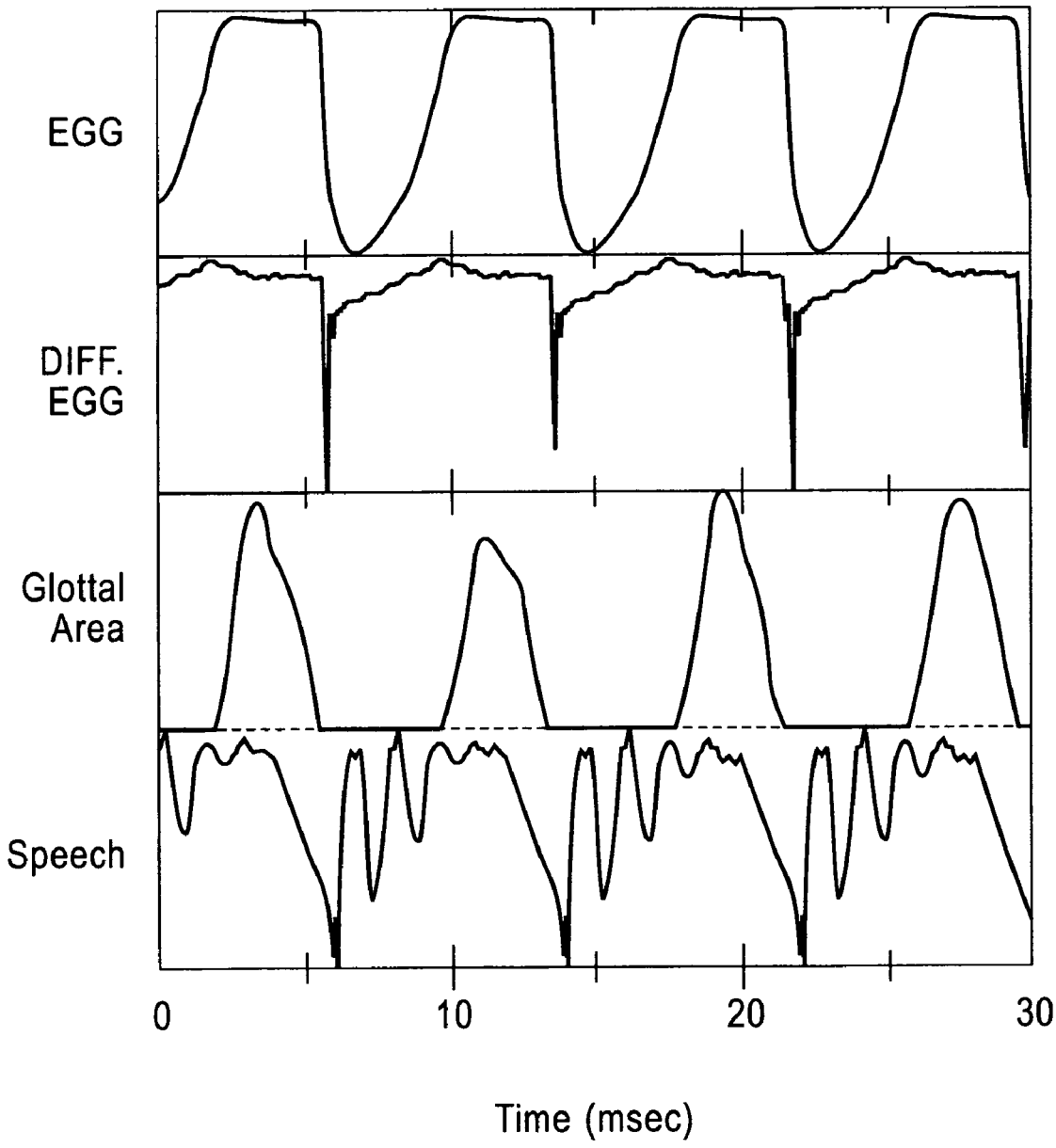
FIG. 3 schematically illustrates the varying of an EGG signal, DEGG signal, glottal area, and speech signal over time, and the correspondence relationships between them.

FIG. 3 schematically illustrates the variations of an EGG signal, DEGG signal, glottal area, and speech signal over time and the correspondence relationships. As shown, there are evident correlation and correspondence relationships between the waveforms of the EGG signal, DEGG signal and the speech output signal. Therefore, the speech signal can be regarded as the result of processing of the EGG or DEGG signal as the input by the vocal tract filter.

Figure 4:
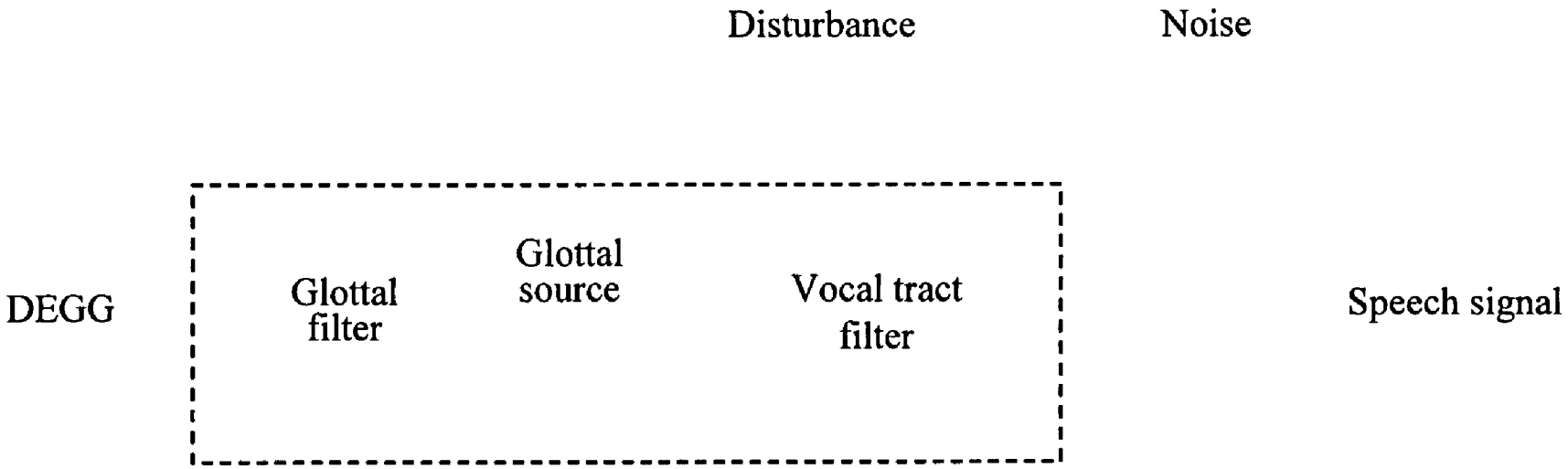
FIG. 4 illustrates an extended source-filter model using a DEGG signal adopted by the present invention.

FIG. 4 illustrates an extended source-filter model using a DEGG signal. As shown, in this model, the glottal source signal as the input to the vocal tract filter is regarded as the output of a glottal filter, and is generated from a DEGG signal inputted into the glottal filter. Then, as in a conventional source-filter model, the glottal source signal is inputted into the vocal tract filter, which, while processing the glottal source signal, receives disturbances, and the output of which, added with noise, generates the final speech signal.

Figure 5:
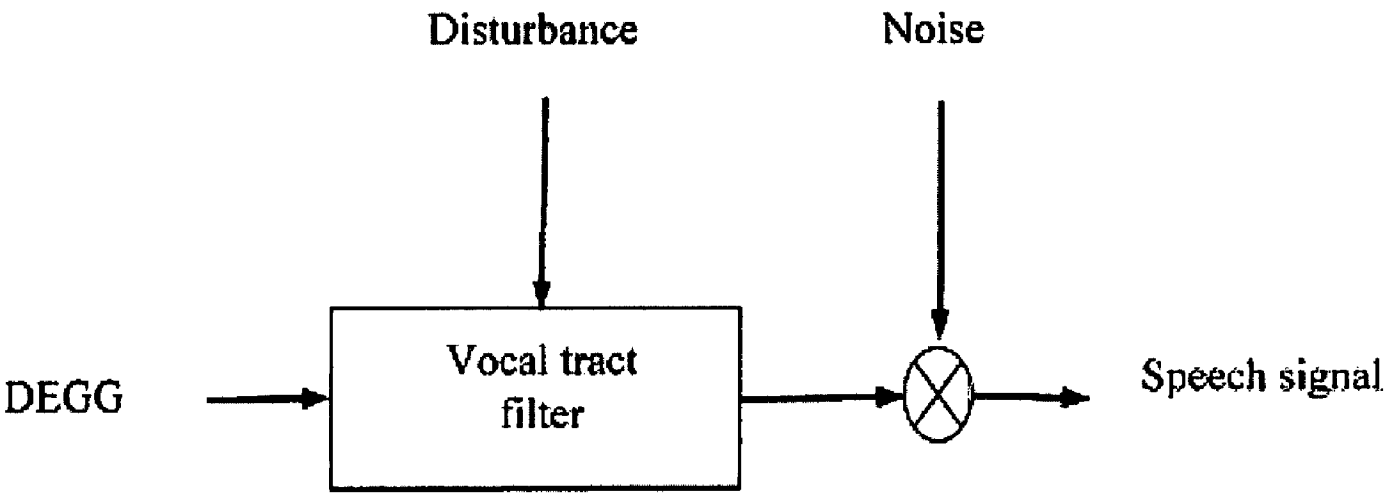
FIG. 5 illustrates a simplified source-filter model of the present invention.

The extended source-filter model can be simplified as a simplified source-filter model as shown in FIG. 5. As shown, the glottal filter and vocal tract filter in the above-described source-filter model are combined into a single vocal tract filter, thus, the DEGG signal becomes the input of this vocal tract filter. The vocal tract filter processes the DEGG signal, receives disturbance during the processing, and its output result, added with noise, becomes the output speech signal.

The present invention is based on this simplified source-filter model and regards the speech signal as the output of the vocal tract filter after processing the DEGG signal. Its objective is, given the recorded speech signal and the corresponding DEGG signal recorded simultaneously, how to estimate the features of the vocal tract filter, that is, the state of the vocal tract filter varying over time. This is a deconvolution problem.

The state of the vocal tract filter can be fully represented by its unit impulse response. As is known by those skilled in the relevant art, an impulse response of a system, briefly speaking, is the output of a system when it receives a very short signal, i.e., an impulse, and its unit impulse response is its output when it receives a unit impulse (that is, an impulse which is zero at all time points except at the zero time point, and the integral of which is 1 over the entire time axis). As is known by those skilled in the relevant art, any signal can be regarded as a linear addition of a series of unit impulses after being shifted and multiplied by some coefficients and, for a linear time-invariant (LTI) system, its output signal generated from an input signal is equal to the same linear addition of the outputs generated respectively from each of the linear components of the input signal. Therefore, the output signal of a linear time-invariant system from any input signal can be regarded as the linear addition of a series of unit impulse responses after being shifted and multiplied by coefficients. That is to say, given the unit impulse response of a linear time-invariant system, the output signal of the system generated from any input signal can be obtained, that is, the state of the system can be uniquely defined by its unit impulse response.

Although most real systems are not strictly linear time-invariant systems, most systems can be approximated by linear time-invariant systems within a certain range of conditions.

Although a vocal tract filter is time-variant, in a short period of time, a vocal tract filter can be deemed invariant. Therefore, its state at any given time point can be determined uniquely by its unit impulse response at the time point.

The present invention uses the Kalman filter to estimate the state of the vocal tract filter at any given time point, i.e., its unit impulse response at the time point. As is known by those skilled in the relevant art, the Kalman filter is a highly efficient recursive filter and can be represented as a set of mathematical equations. It estimates the state of a dynamic system based on a series of incomplete and noisy measurements, while minimizing the mean squared error of the estimation. It can be used to estimate the past, present, and even future states of a system.

The Kalman filtering is based on a linear dynamic system discretized in the time domain. Its base model is a hidden Markov chain built on a linear operator disturbed by Gauss noise. The state of the system can be represented by a real number vector. At each discrete time increment, a linear operator is applied to the state to generate a new state, with some noise added, as well as optionally some information from the system control (if known). Then, another linear operator and further noise combine to generate a visible output from the hidden state.

The Kalman filtering assumes that the real state of the system at time point k is developed from the state at time point (k−1) according to the following state function:

$$x_k=Ax_{k-1}+Bu_k+d_k$$

wherein

A is a state transition model applied to a previous state $x_{k-1}$;

B is a control output model applied to a control vector $u_k$;

$d_k$ is process noise, which is assumed to be white noise with a normal probability distribution (zero mean multivariate normal probability distribution with a covariance Q): $d_k \sim N(0,Q)$ At time point k, the observed value (or measured value) of the real state $x_k$ is obtained according to the following observation equation:

$$v_k=Hx_k+n_k$$

wherein, H is an observation model mapping the real state space to the observation space, and $n_k$ is observation noise, which is assumed to be a zero-mean Gauss white noise with a covariance R $$n_k \sim N(0,R)$$

The initial state and the noise vector $\{x_0, w_1, \ldots, w_k, v_1 \ldots v_k\}$ at each step are assumed to be independent of one another.

The Kalman filter is a recursive estimator, which means only the estimated state from the previous step and the current measured value are needed to calculate the estimated value of the current state, without needing the history of the observation and/or estimation.

The state of the system is represented by two variables:

$x_k$*, the estimated value of the state at time point k;

$P_k$, the error covariance matrix (the estimation precision of the estimated state value).

The Kalman filtering has two distinct phases: pre-estimation and correction. The pre-estimation phase uses the estimated value from a previous time point to generate the estimated value of the current state. In the correction phase, the measurement information from the current time point is used to improve the pre-estimation, so as to obtain a new and possibly more precise estimated value.

Pre-estimation:

$$x_k^-=Ax_{k-1}^*+Bu_{k-1} \text{ (pre-estimated state)}$$

$$P_k^-=AP_{k-1}A^T+Q \text{ (the covariance of the estimated value of the pre-estimation)}$$

Correction:

$$K_k=P_k^-H^T(HP_k^-H^T+R)^{-1} \text{ (Kalman gain)}$$

$$x_k^*=x_k^-+K_k(v_k-Hx_k^-) \text{ (corrected state)}$$

$$P_k=(I-K_kH)P_k^- \text{ (corrected covariance of the estimated value)}$$

These two phases progress recursively with the increment of k.

Wherein:

$x_k$~ represents the pre-estimated state value, that is, the state of step k pre-estimated based on the state of step k−1;

$x_k$* represents the corrected state value, that is, the pre-estimated value corrected based on the observation of step k;

$P_k$~ represents the pre-estimated value of the covariance matrix of the estimation error;

$P_k$ represents the covariance matrix of the estimation error;

Q represents the covariance matrix of the disturbance;

$K_k$ represents the Kalman gain, which is actually a feedback factor for correcting the pre-estimated value;

I is the unit matrix, that is, its diagonal elements are 1s, and all the rest of the elements are zeros.

In an embodiment of the present invention, the specific form of the state equation and the observation equation is as follows:

state equation $$x_k=x_{k-1}+d_k, \text{ and}$$

observation equation $$v_k=e_k^Tx_k+n_k,$$

wherein, $x_k=[x_k(0), x_k(1), \ldots, x_k(N-1)]^T$ represents the state vector to be estimated of the vocal tract filter at time point k, wherein $x_k(0), x_k(1), \ldots, x_k(N-1)$ represents N samples of the expected unit impulse of the vocal tract filter at time point k;

$d_k=[d_k(0), d_k(1), \ldots, d_k(N-1)]^T$ represents the disturbance added to the state vector at time point k, that is, the drift of the vocal tract filter parameters over time at time point k, which is simplified as white noise in the present invention;

$e_k=[e_k, e_{k-1}, \ldots, e_{k-N+1}]^T$ is a vector, in which the element $e_k$ represents the DEGG signal inputted at time point k;

$v_k$ represents the speech signal as the output of the vocal tract filter at time point k; and $n_k$ represents the observation noise added to the outputted speech signal at time point k.

That is to say, in this embodiment of the present invention, relative to the above Kalman equation of the general, assume:

A=I

B=0

$H=e_k^T$

Also, R is a one-dimensional variable

R=r

Then, in the embodiment of the present invention, the corresponding particular Kalman formula is as follows:

1. pre-estimation $$x_k^-=x_{k-1}^*,$$

$$P_k^-=P_{k-1}+Q$$

2. correction $$K_k=P_k^-e_k[e_k^TP_k^-e_k+r]^{-1}$$

$$x_k^*=x_k^-+K_k[v_k-e_k^Tx_k^-]$$

$$P_k=[I-K_ke_k^T]P_k^-$$

3. recursion $$k=k+1;$$

wherein, $x_k$~ represents the pre-estimated state value at time point k; $x_k$* represents the corrected state value at time point k; $P_k$~ represents the pre-estimated value of the covariance matrix of the estimation error; $P_k$ represents the corrected value of the covariance matrix of the estimation error; Q represents the covariance matrix of the disturbance; $K_k$ represents the Kalman gain; r represents the variance of the observation noise; and I represents the unit matrix.

In this way, through the above Kalman filtering process, the state of the vocal tract filter at each time point, i.e., its series of unit impulse response at each time point corresponding to the DEGG/EGG signal, is estimated. That is, in an embodiment of the present invention, a source-filter model is used, the DEGG/EGG signal is regarded as the input signal of the vocal tract filter, the speech signal is regarded as the output signal of the vocal tract filter, the vocal tract filter is regarded as a dynamic system the state of which varies over time, and based on the recorded speech signal as the output signal of the vocal tract filter and the DEGG/EGG signal as the input signal of the vocal tract filter, the Kalman filtering is used to obtain the state of the vocal tract filter varying over time, that is, the features of the vocal tract filter during the speech utterance. The state or features of the vocal tract filter reflects the state of the speaker's vocal tract filter varying over time during his utterance of the corresponding speech content, and the state or features of the vocal tract filter can be used in combination with various glottal source signals to form a new speech of this speech content having a new speaker's characteristics or other speech characteristics.

The change of the state of the vocal tract filter is continuous, and the estimation of its state is also continuous, but preferably a state can be recorded at every specific interval. The choice of the recording interval can be based on a variety of criteria. For example, in an exemplary embodiment of the present invention, a state is recorded at every 10 ms, thus a time series of the filter parameters are formed.

In the above Kalman filtering process, the Kalman filter can be initialized in the following way. Since in a normal situation, the Kalman filtering is insensitive to the choice of its initial value, only as an example, the initial value can be $x_0=0$. The value of the noise variance r can be an estimated value chosen based on the specific signal strength and signal-noise ratio. For example, in the experiment, the maximum amplitude of useful signals is 20000, and the estimate quantity of the noise variance r is 200*200=40000. For the sake of simplicity, $P_0$ and Q can be diagonal matrixes. For example, the diagonal elements of $P_0$ can be 1.0, and the diagonal elements of Q can be 0.01*0.01=0.0001 (which can be increased as appropriate for a low sampling rate). The specific chosen values can be adjusted by experiments. Only as an example, N can be 512.

In principle, the method of the present invention is applicable to various sampling frequencies. In order to ensure a good speech quality, a sampling frequency of more than 16 KHz can be adopted for both the speech signal and the DEGG/EGG signal. For example, in an embodiment of the present invention, a sampling frequency of 22 KHz is adopted.

In a preferred embodiment of the present invention, a two-way Kalman filtering is used instead of the above normal (i.e., forward) Kalman filer. The two-way Kalman filtering comprises, in addition to the above forward Kalman filtering in which a future state is estimated from a past state, a backward Kalman filtering in which a past state is estimated from a future state, and combines the estimation results of these two processes together. In this way, during the estimation of the state or parameters, not only past information, but also future information, is utilized, thus in fact changing the estimation from extrapolation to interpolation.

The forward Kalman filtering is as described above. The backward Kalman filtering is performed using the following formulas:

Backward pre-estimation $$x_k^- = x_{k+1}^*,$$

$$P_k^- = P_{k+1} + Q$$

Correction:

$$K_k = P_k^- e_k [e_k^T P_k^- e_k + r]^{-1}$$

$$x_k^* = x_k^- + K_k [v_k - e_k^T x_k^-]$$

$$P_k = [I - K_k e_k^T] P_k^-$$

Backward recursion $$k = k - 1;$$

wherein, $x_k$~ represents the pre-estimated state value at time point k; $x_k$* represents the corrected state value at time point k; $P_k$~ represents the pre-estimated value of the covariance matrix of the estimation error; $P_k$ represents the corrected value of the covariance matrix of the estimation error; Q represents the covariance matrix of the disturbance; $K_k$ represents the Kalman gain; r represents the variance of the observation noise; and I represents the unit matrix.

The estimation results of the two-way Kalman filtering are the combination of estimation results of the forward Kalman filtering and those of the backward Kalman filtering using the following formulas:

$$P_k = (P_{k+}^{-1} + P_{k-}^{-1})^{-1},$$

$$x_k^* = P_k (P_{k+}^{-1} x_{k+}^* + P_{k-}^{-1} x_{k-}^*),$$

wherein, $P_{k+}$, $x_{k+}$ are the pre-estimated value of the state of the vocal tract filter and the covariance of the estimation obtained by the forward Kalman filtering respectively, and $P_{k-}$, $x_{k-}$ are the pre-estimated value of the state of the vocal tract filter and the covariance of the estimation obtained by the backward Kalman filtering respectively.

Figure 6:
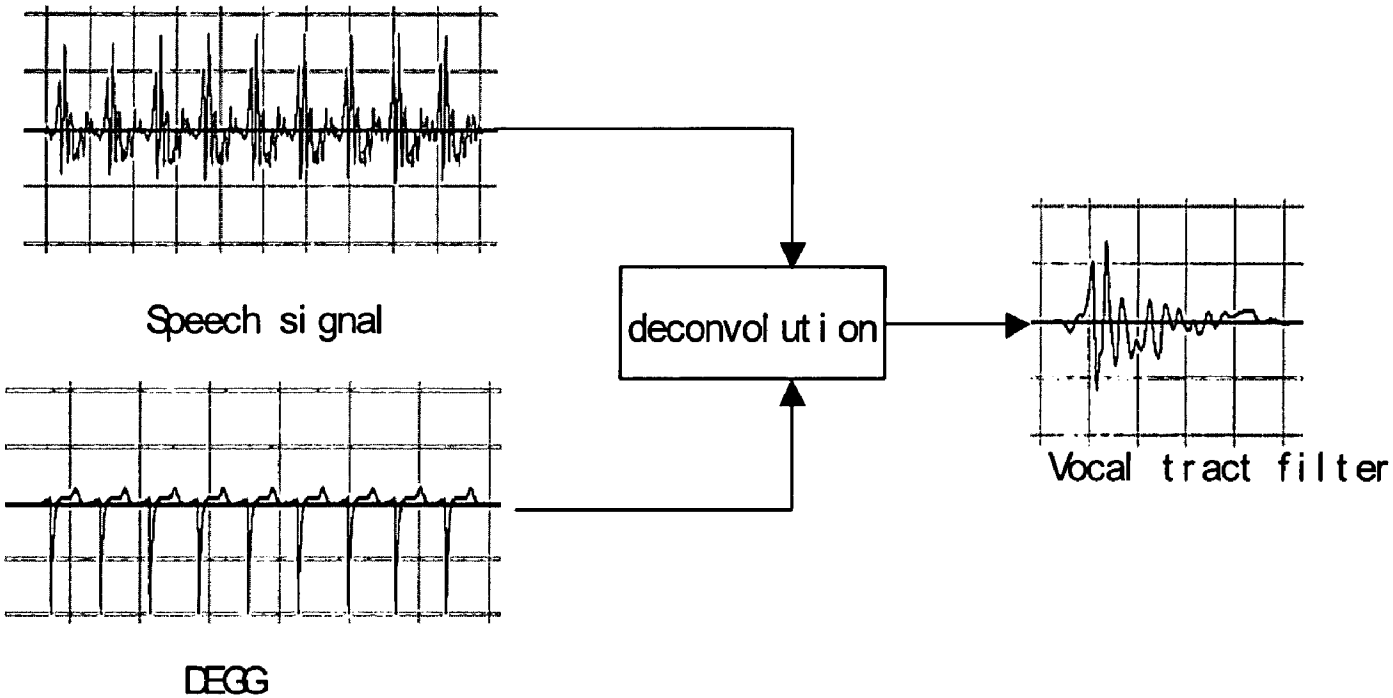
FIG. 6 illustrates an example of performing speech analysis using the speech analysis method of the present invention.

FIG. 6 illustrates an example of speech analysis performed using the speech analysis method of the present invention. This diagram shows the results of the processing performed on the Chinese vowel "a" uttered by someone according to the present invention. As shown, deconvolution is performed on the speech signal and its corresponding DEGG signal using the two-way Kalman filtering, so as to obtain a state diagram of the vocal tract filter as shown. The state diagram faithfully reflects the state of the speaker's vocal tract filter varying over time when he utters this voice. The state of the vocal tract filter corresponding to this speech content can be combined with other glottal source signal, so as to synthesize a speech of this speech content with new speech characteristics.

Figure 7:
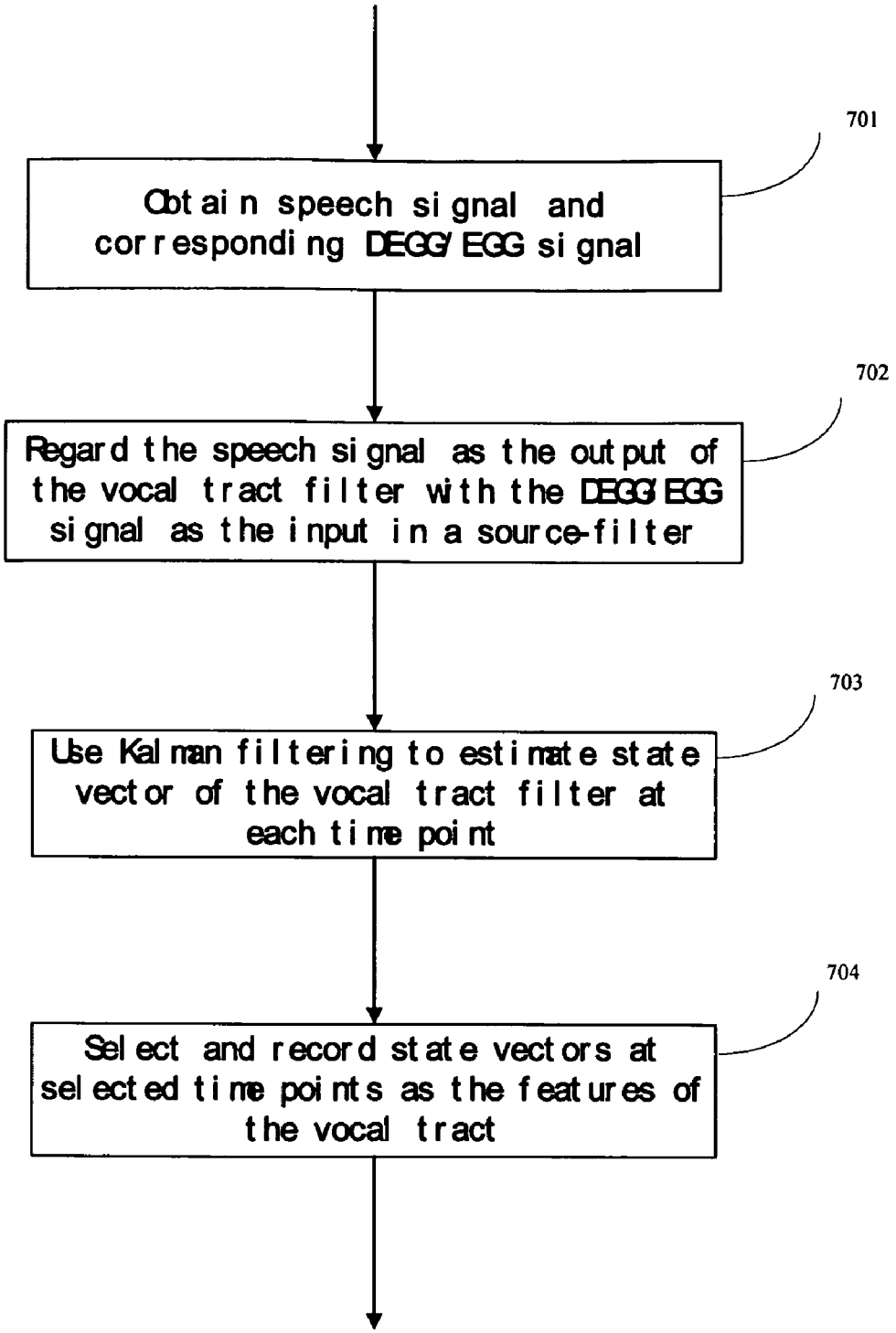
FIG. 7 illustrates the process flow of a speech analysis method according to an embodiment of the present invention.

FIG. 7 illustrates the process flow of the speech analysis method as described above. As shown, in step 701, the speech signal and the corresponding DEGG/EGG signal recorded simultaneously are obtained. In step 702, the speech signal is regarded as the output of the vocal tract filter with the DEGG/EGG signal as the input in a source-filter model. In step 703, the state vector of the vocal tract filter at each time point is estimated from the speech signal as the output and the DEGG/EGG signal as the input using the Kalman filtering or preferably using the two-way Kalman filtering. And preferably, in step 704, the estimated values of the state vectors of the vocal tract filter as obtained by the Kalman filtering at selected time points are selected and recorded, as the features of the vocal tract filter.

Figure 8:
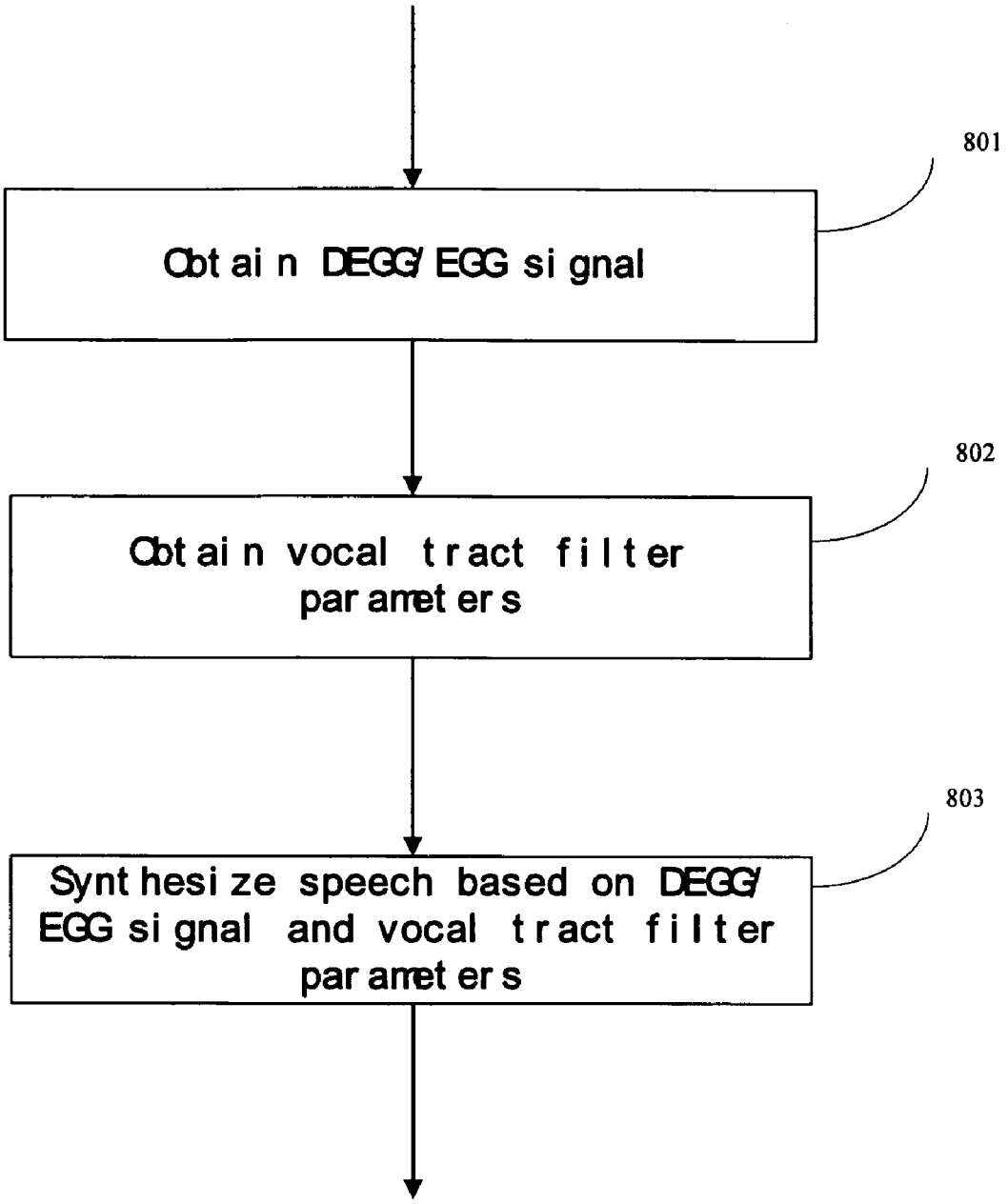
FIG. 8 illustrates the process flow of a speech synthesis method according to an embodiment of the present invention.

In another aspect of the present invention, there is further provided a speech analysis method using the features of the vocal tract filter as generated using the speech analysis method of the present invention as described above. FIG. 8 illustrates the process flow of the speech synthesis method.

As shown, in step 801, a DEGG/EGG signal is obtained. Preferably, a DEGG/EGG signal of a single period can be used to reconstruct a full DEGG/EGG signal based on a given fundamental frequency and time length. The DEGG/EGG signal only contains rhythmic information, and can only synthesize meaningful speech signal in combination with appropriate vocal tract filter parameters. The DEG/EGG signal of a single period can either come from the same speakers' same speech content as the DEGG/EGG signal which has been used for generating the vocal tract filter parameters, or come from the same speakers' different speech content, or come from a different speaker's same or different speech content. Therefore, this speech synthesis can be used to change the pitch, strength, speed, quality and other characteristics of the original speech.

In step 802, the vocal tract filter parameters are obtained using the above speech analysis method of the present invention. As described above, preferably the two-way Kalman filtering process is used to generate the vocal tract filter parameters based on the speech signal and DEGG/EGG signal recorded simultaneously. The vocal tract filter parameters reflect the state or features of the speaker's vocal tract filter when he utters the corresponding speech content.

In step 803, speech synthesis is performed based on the DEGG/EGG signal and the obtained features of the vocal tract filter. As can be known be those skilled in the art, a speech signal can be synthesized easily based on the DEGG/EGG signal and the vocal tract filter parameters by using a convolution process.

Figure 9:
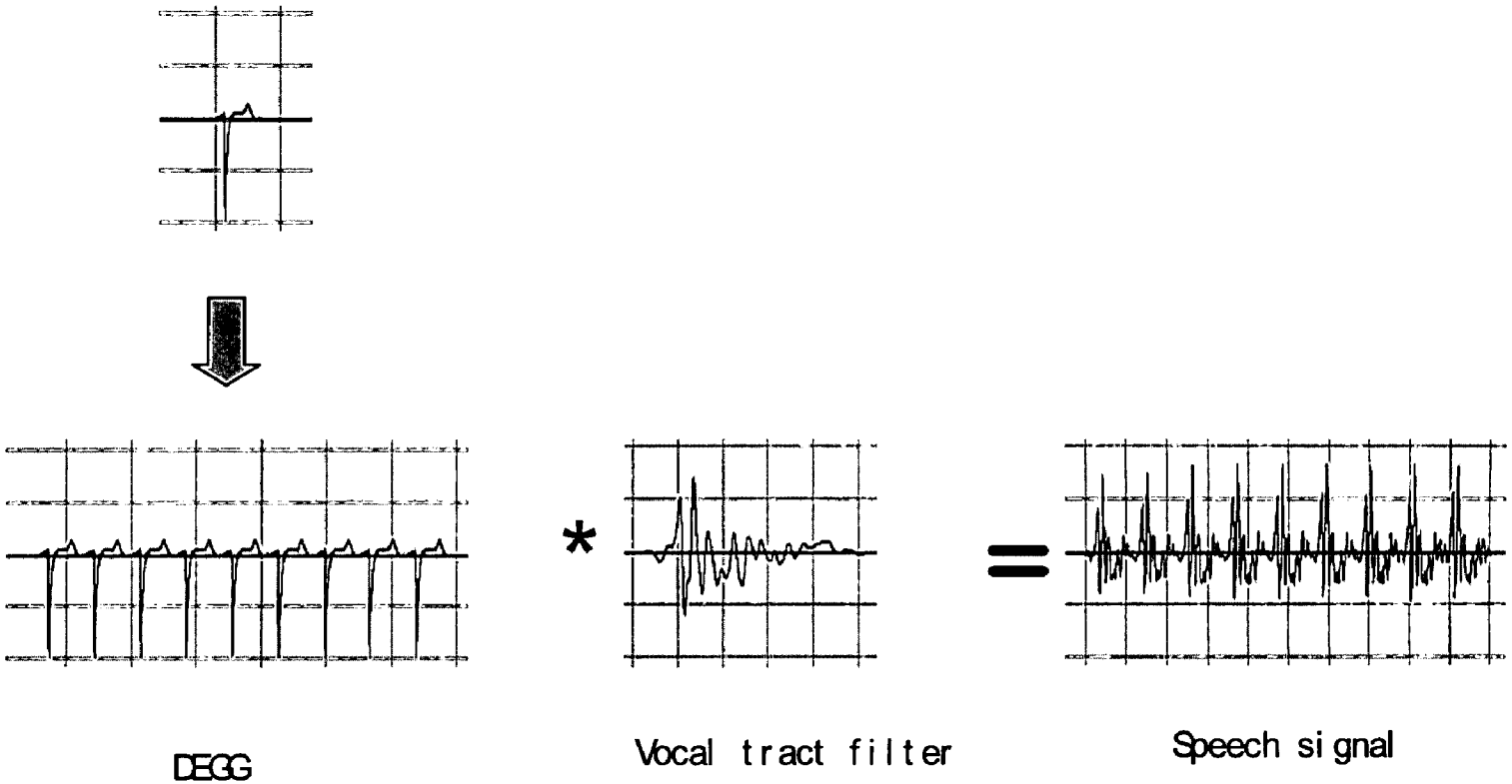
FIG. 9 illustrates an example of the process of synthesizing speech using the speech synthesis method according to an embodiment of the present invention.

FIG. 9 illustrates an example of the speech synthesis process using the speech synthesis method. The diagram shows the process of synthesizing a speech signal of the Chinese vowel "a" with new speech characteristics using a reconstructed DEGG signal and the vocal tract filter parameters generated using the process as shown in FIG. 6. As shown, first the DEGG (or EGG) signal is obtained. Then, the reconstructed signal is convolved with vocal tract filter parameters generated by the above speech analysis method of the present invention, so as to synthesize a new speech signal with new speech characteristics corresponding to the speech content.

It is to be noted that the speech analysis method and the speech synthesis method as described above and shown in the diagrams are only exemplary and illustrative of the speech analysis method and speech synthesis method of the present invention, and are not meant to be limiting the present invention. The speech analysis method and speech synthesis method of the present invention can have more, less or different steps, and the orders between steps can alter.

The present invention further comprises a speech analysis apparatus and speech synthesis apparatus corresponding to the above speech analysis method and speech synthesis method respectively.

Figure 10:
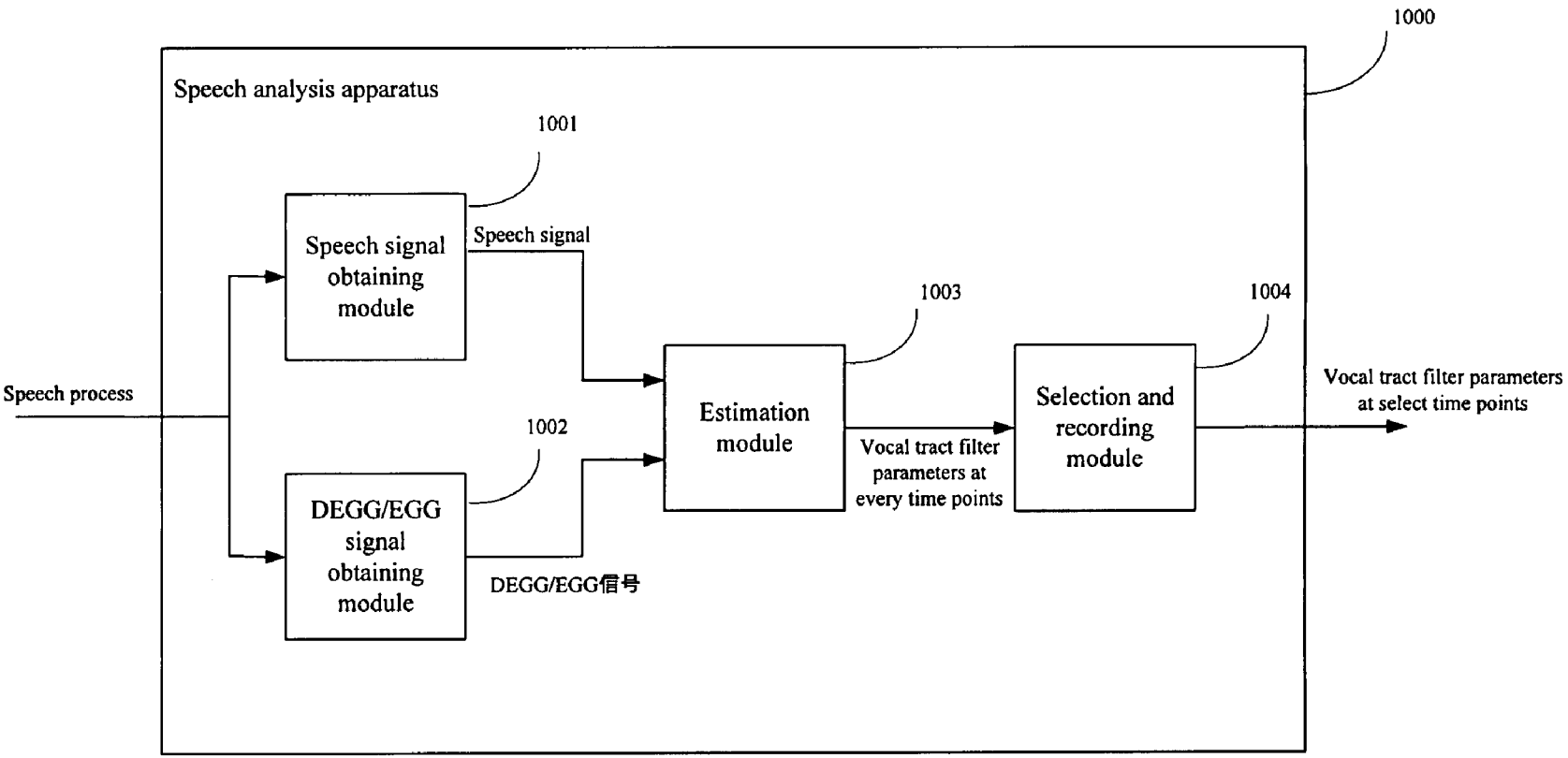
FIG. 10 illustrates a schematic diagram of a speech analysis apparatus according to an embodiment of the present invention.

FIG. 10 illustrates a schematic block diagram of a speech analysis apparatus according to an embodiment of the present invention. As shown, the speech analysis apparatus 100 comprises a speech signal obtaining module 1001, a DEGG/EGG signal obtaining module 1002, an estimation module 1003, and a selecting and recording module 1004. Wherein, the speech signal obtaining module 1001 is used for obtaining the speech signal during the speaker's utterance, and providing the speech signal to the estimation module 1003. The DEGG/EGG signal obtaining module is used for recording simultaneously the DEGG/EGG signal during the speaker's utterance corresponding to the obtained speech signal, and providing the DEGG/EGG signal to the estimation module 1003. The estimation module 1003 is used for estimating the features of the vocal tract filter based on the speech signal and the DEGG/EGG signal. During the estimation process, the estimation module 1003 uses a source-filter module, regards the DEGG/EGG signal as the source input into the vocal tract filter, and regards the speech signal as the output of the vocal tract filter, so as to estimate the features of the vocal tract filter based on the input and output of the vocal tract filter.

Preferably, the estimation module 1003 uses the state vectors of the vocal tract filter at given time points to represent the features of the vocal tract filter, and uses the Kalman filtering process to perform the estimation, that is, the estimation module 1003 is implemented as the Kalman filter.

The state equation and the observation equation on which the Kalman filtering is based, as well as the specific process of the Kalman filtering and the two-way Kalman filtering are as described above in respect of the speech analysis process according to the present invention, and will not be repeated here.

Preferably, the speech analysis apparatus 100 further comprises a selection and recording apparatus 1004 for selecting and recording the estimated state values of the vocal tract filter at given time points obtained from the Kalman filtering process, as the features of the vocal tract filter. Only as an example, the selection and recording apparatus can select and record the estimated state values of the vocal tract filter obtained from the Kalman filtering process at a regular time interval, such as 10 ms.

Figure 11:
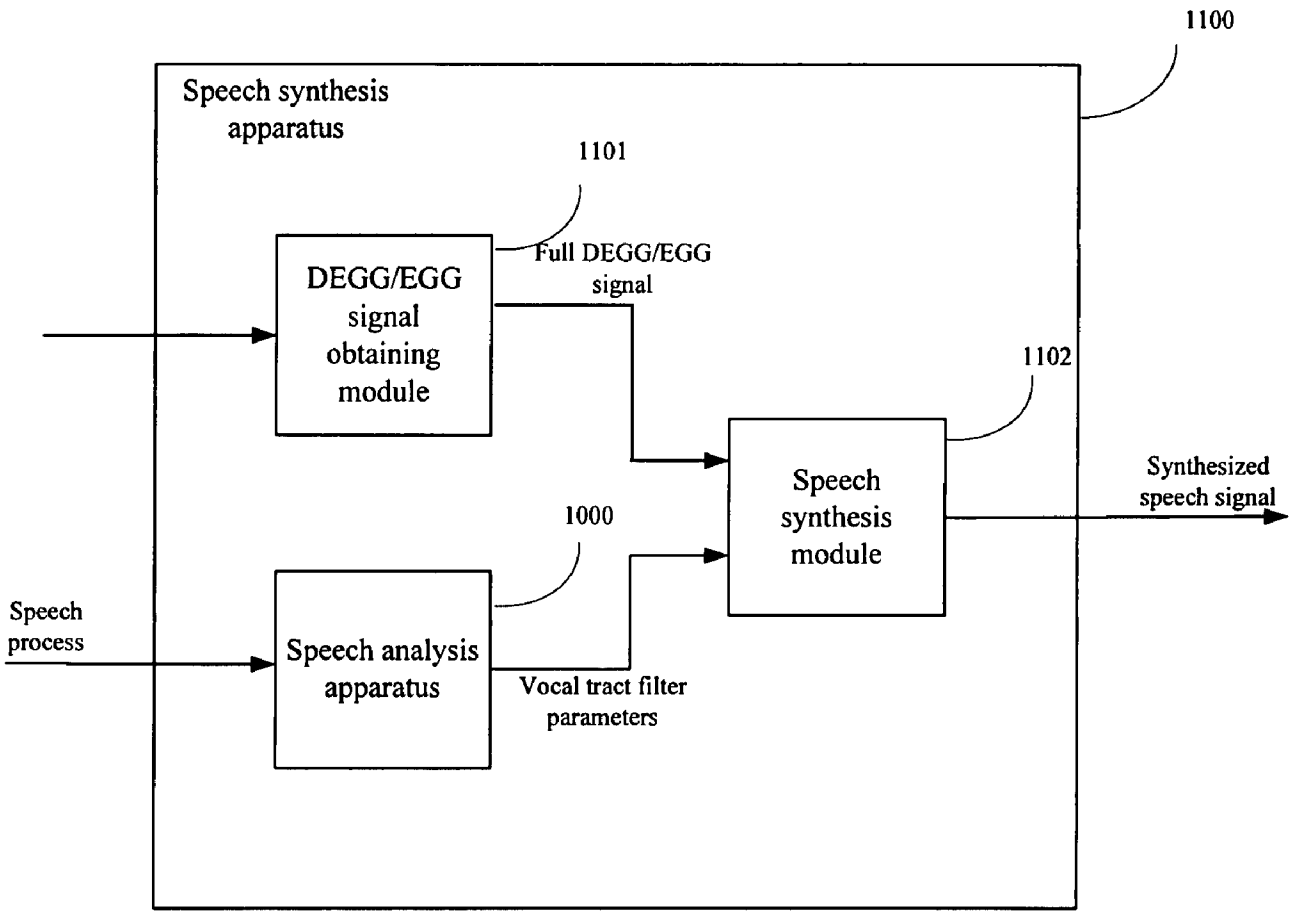
FIG. 11 illustrates a schematic diagram of a speech synthesis apparatus according to an embodiment of the present invention.

FIG. 11 illustrates a schematic diagram of a speech synthesis apparatus according to an embodiment of the present invention. As shown, the speech synthesis apparatus 1100 according to an embodiment of the present invention comprises a DEGG/EGG signal obtaining module 1101, the above-described speech analysis apparatus 1000 according to the present invention, and a speech synthesis module 1102, wherein, the speech synthesis module 1102 is used for synthesizing a speech signal based on the DEGG/EGG signal as obtained by the DEGG/EGG signal obtaining module and the features of the vocal tract filter as estimated by the speech analysis apparatus. As can be readily understood by those skilled in the art, the speech synthesis module 1102 can use a method such as convolution to synthesize a speech signal based on the DEGG/EGG signal and the features of the vocal tract filter.

Preferably, the DEGG/EGG signal obtaining module 1101 is further configured to reconstruct a full DEGG signal using a DEGG signal of a single period based on a given fundamental frequency and time length.

It is to be noted that the speech analysis apparatus and speech synthesis apparatus as described above and illustrated in the drawings are only exemplary and illustrative of the speech analysis apparatus and speech synthesis apparatus of the present invention, and are not meant to be limiting thereof. The speech analysis apparatus and speech synthesis apparatus of the present invention may have more, less or different modules, and the relationships between the modules can be unlike those illustrated and described hereinabove. For example, the selection and recording module 1004 can also be part of the estimation module 1003, and so on.

The speech analysis and speech synthesis methods and apparatus of the present invention have a prospect of wide application in speech-related technical fields. For example, the speech analysis and speech synthesis methods and apparatus of the present invention can be used in small footprint and high quality speech synthesis or embedded speech synthesis systems. Such systems need a very small data volume, such as about 1 M. The speech analysis and speech synthesis methods and apparatus of the present invention can also be a useful tool in small footprint speech analysis, speech recognition, speaker recognition/confirmation, speech conversion, emotional speech synthesis or other speech techniques.

The present invention can be realized in hardware, software, firmware or any combination thereof. A typical combination of hardware and software can be a general-purpose or specialized computer system with a computer program and equipped with speech input and output devices, which computer program, when being loaded and executed, controls the computer system and its components to carry out the methods described herein.

Although the present invention has been shown and described specifically with reference to preferred embodiments, it will be understood by those skilled in the art that various changes may be made therein both in form and in details without departing from the spirit and scope of the present invention.

The invention claimed is:

1. A speech analysis method, comprising the steps of:

obtaining a speech signal and a corresponding DEGG/EGG signal;

providing the speech signal as the output of a vocal tract filter in a source-filter model taking the DEGG/EGG signal as the input; and estimating the features of the vocal tract filter from the speech signal as the output and the DEGG/EGG signal as the input, wherein the features of the vocal tract filter are expressed by the state vectors of the vocal tract filter at selected time points, and the step of estimating is performed using Kalman filtering, wherein the Kalman filtering is a two-way, bi-directional Kalman filtering comprising a forward Kalman filtering in which a future state is estimated from a past state and a backward Kalman filtering in which a past state is estimated from a future state, and wherein the forward Kalman filtering comprises forward estimation, correction and forward recursion, the backward Kalman filtering comprises backward estimation, correction and backward recursion, and estimation results of the two-way Kalman filtering are a combination of estimation results of the forward Kalman filtering and estimation results of the backward Kalman filtering, wherein Kalman filtering is based on:

a state function $$x_k=x_{k-1}+d_k, \text{ and}$$

an observation function $$v_k=e_k^T x_k+n_k,$$

wherein, $x_k=[x_k(0), x_k(1), \ldots x_k(N-1)]^T$ represents the state vector to be estimated of the vocal tract filter at time point k, wherein $x_k=[x_k(0), x_k(1), \ldots x_k(N-1)$ represent N samples of the expected unit impulse response of the vocal tract filter at time k;

$d_k=[d_k(0), d_k(1), \ldots d_k(N-1)]^T$ represents the disturbance added to the state vector of the vocal tract filter at time k;

$e_k=[e_k, e_{k-1}, \ldots, e_{k-N+1}]^T$ is a vector, of which the element $e_k$ represents the DEGG signal inputted at time k;

$v_k$ represents the speech signal outputted at time k; and $n_k$ represents the observation noise added to the outputted speech signal at time k, and wherein the forward Kalman filtering comprises the steps of:

forward estimation:

$$x_k^-=x_{k-1}^*,$$

$$P_k^-=P_{k-1}+Q$$

correction:

$$K_k=P_k^- e_k[e_k^T P_k^- e_k+r]^{-1}$$

$$x_k^*=x_k^-+K_k[v_k-e_k^T x_k^-]$$

$$P_k=[I-K_k e_k^T]P_k^-$$

forward recursion $$k=k+1;$$

the backward Kalman filtering comprises the steps of:

backward estimation:

$$x_k^-=x_{k+1}^*;$$

$$P_k^-=P_{k+1}+Q$$

correction:

$$K_k=P_k^- e_k[e_k^T P_k^- e_k+r]^{-1}$$

$$x_k^*=x_k^-+K_k[v_k-e_k^- x_k^-]$$

$$P_k=[I-K_k e_k^T]P_k^-$$

backward recursion $$k=k-1;$$

wherein, $x_k^-$ represents the estimated state value at time point k, $x_k^*$ represents the corrected state value at time point k, $P_k^-$ represents the pre-estimated value of the covariance matrix of the estimation error, $P_k$ represents the corrected value of the covariance matrix of the estimation error, Q represents the covariance matrix of disturbance $d_k$, $K_k$ represents the Kalman gain, r represents the variance of the observation noise $n_k$, I represents the unit matrix; and the estimation results of the two-way Kalman filtering are the combination of the estimation results of the forward Kalman filtering and those of the backward Kalman filtering using the following formula:

$$P_k=(P_{k+}^{-1}+P_{k-}^{-1})^{-1},$$

$$x_k^*=P_k(P_{k+}^{-1}x_{k+}^*+P_{k-}^{-1}x_{k-}^*),$$

wherein, $P_{k+}$, $x_{k+}$ are the estimated state value and the covariance of the estimation obtained by the forward Kalman filtering respectively, and $P_{k-}$, $x_{k-}$ represent the estimated state value and the covariance of the estimation obtained by the backward Kalman filtering respectively.

2. The speech analysis method according to claim 1, further comprising the step of selecting and recording the estimated state values of the vocal tract filter at selected time points obtained by the Kalman filtering, as the features of the vocal tract filter.

3. A speech synthesis method, comprising the steps of:

obtaining a DEGG/EGG signal;

obtaining the features of a vocal tract filter by:

obtaining a speech signal and a corresponding DEGG/EGG signal;

providing the speech signal as the output of a vocal tract filter in a source-filter model taking the DEGG/EGG signal as the input; and estimating the features of the vocal tract filter from the speech signal as the output and the DEGG/EGG signal as the input, wherein the features of the vocal tract filter are expressed by the state vectors of the vocal tract filter at selected time points, and the step of estimating is performed using Kalman filtering, wherein the Kalman filtering is a two-way, bi-directional Kalman filtering comprising a forward Kalman filtering in which a future state is estimated from a past state and a backward Kalman filtering in which a past state is estimated from a future state, and wherein the forward Kalman filtering comprises forward estimation, correction and forward recursion, the backward Kalman filtering comprises backward estimation, correction and backward recursion, and estimation results of the two-way Kalman filtering are a combination of estimation results of the forward Kalman filtering and estimation results of the backward Kalman filtering; and synthesizing speech based on the DEGG/EGG signal and the obtained features of the vocal tract filter, wherein Kalman filtering is based on:

a state function $$x_k=x_{k-1}+d_k, \text{ and}$$

an observation function $$v_k=e_k^T x_k+n_k,$$

wherein, $x=[x_k(0), x_k(1), \ldots, x_k(N-1)]^T$ represents the state vector to be estimated of the vocal tract filter at time point k, wherein $x_k(0), x_k(1), \ldots, x_k(N-1)$ represent N samples of the expected unit impulse response of the vocal tract filter at time k;

$d_k=[d_k(0), d_k(1), \ldots, d_k(N-1)]_T$ represents the disturbance added to the state vector of the vocal tract filter at time k;

$e_k=[e_k, e_{k-1}, \ldots, e_{k-N+1}]^T$ is a vector, of which the element $e_k$ represents the DEGG signal inputted at time k;

$v_k$ represents the speech at time k; and $n_k$ represents the observation noise added to the outputted speech signal at time k, and wherein the forward Kalman filtering comprises the steps of:

$$x_k^-=x_{k-1}^*,$$

$$P_k^-=P_{k-1}+Q$$

correction:

$$K_k=P_k^- e_k[e_k^T P_k^- e_k+r]^{-1}$$

$$x_k^*=x_k^-+K_k[v_k-e_k^T x_k^-]$$

$$P_k=[I-K_k e_k^T]P_k^-$$

forward recursion $$k=k+1;$$

the backward Kalman filtering comprises the steps of:

backward estimation:

backward estimation:

$$x_k^-=x_{k+1}^*;$$

$$P_k^-=P_{k+1}+Q$$

correction:

$$K_k=P_k^- e_k[e_k^T P_k^- e_k+r]^{-1}$$

$$x_k^*=x_k^-+K_k[v_k-e_k^- x_k^-]$$

$$P_k=[I-K_k e_k^T]P_k^-$$

backward recursion $$k=k-1;$$

wherein, $x_k^-$ represents the estimated state value at time point k, $x_k^*$ represents the corrected state value at time point $P_k^-$ resents the re-estimated value of the covariance matrix of the estimation error, $P_k$ represents the corrected value of the covariance matrix of the estimation error, represents the covariance matrix of disturbance $d_k$, $K_k$ represents the Kalman gain, r represents the variance of the observation noise $n_k$, I represents the unit matrix; and the estimation results of the two-way Kalman filtering are the combination of the estimation results of the forward Kalman filtering and those of the backward Kalman filtering using the following formula:

$$P_k=(P_{k+}^{-1}+P_{k-}^{-1})^{-1},$$

$$x_k^*=P_k(P_{k+}^*+P_{k-}^{-1}x_{k-}^*),$$

wherein, $P_{k+}$, $x_{k+}$ are the estimated state value and the covariance of the estimation obtained by the forward Kalman filtering respectively, and $P_{k-}$, $x_{k-}$ represent the estimated state value and the covariance of the estimation obtained by the backward Kalman filtering respectively.

4. The speech synthesis method according to claim 3, wherein the step of obtaining the DEGG/EGG signal comprises:

reconstructing a full DEGG/EGG signal using a DEGG/EGG signal of a single period based on a given fundamental frequency and time length.

5. A speech analysis apparatus, comprising:

a processor and a storage device encoded with modules for execution by the processor, the modules including:

a module for obtaining a speech signal;

a module for obtaining the corresponding DEGG/EGG signal; and an estimation module for, by regarding the speech signal as the output of a vocal tract filter in a source-filter model with the DEGG/EGG signal as the input, estimating the features of the vocal tract filter from the speech signal as the output and the DEGG/EGG signal as the input, wherein the estimation module uses the state vectors of the vocal tract filter at selected time points to express the features of the vocal tract filter, and uses Kalman filtering to perform the estimation, wherein the Kalman filtering is a two-way, bi-directional Kalman filtering comprising a forward Kalman filtering in which a future state is estimated from a past state and a backward Kalman filtering in which a past state is estimated from a future state, and wherein the forward Kalman filtering comprises forward estimation, correction and forward recursion, the backward Kalman filtering comprises backward estimation, correction and backward recursion, and estimation results of the two-way Kalman filtering are a combination of estimation results of the forward Kalman filtering and estimation results of the backward Kalman filtering, wherein the Kalman filtering is based on:

a state function $$x_k=x_{k-1}+d_k, \text{ and}$$

an observation function $$v_k=e_k^T x_k+n_k,$$

wherein, $x_k=[x_k(0), x_k(1), \ldots, x_k(N-1)]^T$ represents the state vector to be estimated of the vocal tract filter at time point k, wherein $x_k(0), x_k(1), \ldots, x_k(N-1)$ resent N samples of the expected unit impulse response of the vocal tract filter at time k;

$d_k=[d_k(0), d_k(1), \ldots, d_k(N-1)]^T$ represents the disturbance added to the state vector of the vocal tract filter at time k;

$e_k=[e_k, e_{k-1}, \ldots, e_{k-N+1}]^T$ is a vector, of which the element $e_k$ represents the DEGG signal inputted at time k;

$v_k$ represents the speech signal outputted at time k; and $n_k$ represents the observation noise added to the outputted speech signal at time k, and wherein the forward Kalman filtering comprises the following steps:

forward estimation:

$$x_k^- = x_{k-1}^*,$$

$$P_k^- = P_{k-1} + Q$$

correction:

$$K_k = P_k^- e_k [e_k^T P_k^- e_k + r]^{-1}$$

$$x_k^* = x_k^- + K_k [v_k - e_k^T x_k^-]$$

$$P_k = [I - K_k e_k^T] P_k^-$$

forward recursion $$k = k+1;$$

the backward Kalman filtering comprises the following steps:

backward estimation:

$$x_k^- = x_{k+1}^*;$$

$$P_k^- = P_{k+1} + Q$$

correction:

$$K_k = P_k^- e_k [e_k^T P_k^- e_k + r]^{-1}$$

$$x_k^* = x_k^- + K_k [v_k - e_k^- x_k^-]$$

$$P_k = [I - K_k e_k^T] P_k^-$$

backward recursion $$k = k-1;$$

wherein, $x_k^-$ pre-estimated state value at time point k, $x_k^*$ represents the corrected state value at time point $P_k^-$ represents the pre-estimated value of the covariance matrix of the estimation error, $P_k$ represents the corrected value of the covariance matrix of the estimation error, Q represents the covariance matrix of disturbance $d_k$, $K_k$ represents the Kalman gain, r represents the variance of the observation noise $n_k$, represents the unit matrix; and the estimation results of the two-way Kalman filter are the combination of estimation results of the forward Kalman filter and those of the backward Kalman filtering using the following formula:

$$P_k = (P_{k+}^{-1} + P_{k-}^{-1})^{-1},$$

$$x_k^* = P_k (P_{k+}^* + P_{k-}^{-1} x_{k-}^*),$$

wherein, $P_{k+}$, $x_{k+}$ are the estimated state value and the covariance of the estimation obtained by the forward Kalman filtering respectively, and represent the estimated state value and the covariance of the estimation obtained by the backward Kalman filtering respectively.

6. The speech analysis apparatus according to claim 5, further comprising a selection and recording module for selecting and recording the estimated state values of the vocal tract filter at selected time points obtained by the Kalman filtering, as the features of the vocal tract filter.

7. A speech synthesis apparatus, comprising:

a processor and a storage device encoded with modules for execution by the processor, the modules including:

a module for obtaining a DEGG/EGG signal;

a speech analysis module comprising:

a module for obtaining a speech signal;

a module for obtaining the corresponding DEGG/EGG signal; and an estimation module for, by regarding the speech signal as the output of a vocal tract filter in a source-filter model with the DEGG/EGG signal as the input, estimating the features of the vocal tract filter from the speech signal as the output and the DEGG/EGG signal as the input, wherein the estimation module uses the state vectors of the vocal tract filter at selected time points to express the features of the vocal tract filter, and uses Kalman filtering to perform the estimation, wherein the Kalman filtering is a two-way, bi-directional Kalman filtering comprising a forward Kalman filtering in which a future state is estimated from a past state and a backward Kalman filtering in which a past state is estimated from a future state, and wherein the forward Kalman filtering comprises forward estimation, correction and forward recursion, the backward Kalman filtering comprises backward estimation, correction and backward recursion, and estimation results of the two-way Kalman filtering are a combination of estimation results of the forward Kalman filtering and estimation results of the backward Kalman filtering; and a speech synthesis module for synthesizing a speech signal based on the DEGG/EGG signal obtained by the module for obtaining a DEGG/EGG signal and the features of the vocal tract filter estimated by the speech analysis apparatus, wherein the Kalman filtering is based on:

a state function $$x_k = x_{k-1} + d_k, \text{ and}$$

an observation function $$v_k = e_k^T x_k + n_k,$$

wherein, $x_k = [x_k(0), x_k(1), \ldots, x_k(N-1)]^T$ represents the state vector to be estimated of the vocal tract filter at time point k, wherein $x_k(0)$, $x^k(1)$, . . . , $x_k(N-1)$ represent N samples of the expected unit impulse response of the vocal tract filter at time k;

$d_k = [d_k(0), d_k(1), \ldots, d_k(N-1)]^T$ represents the disturbance added to the state vector of the vocal tract filter at time k;

$e_k = [e_k, e_{k-1}, \ldots, e_{k-N+1}]^T$ is a vector, of which the element $e_k$ represents the DEGG signal inputted at time k;

$v_k$ represents the speech signal outputted at time k; and $n_k$ represents the observation noise added to the outputted speech signal at time k, and wherein the forward Kalman filtering comprises the following steps:

forward estimation:

$$x_k^- = x_{k-1}^*,$$

$$P_k^- = P_{k-1} + Q$$

correction:

$$K_k = P_k^- e_k [e_k^T P_k^- e_k + r]^{-1}$$

$$x_k^* = x_k^- + K_k [v_k - e_k^T x_k^-]$$

$$P_k = [I - K_k e_k^T] P_k^-$$

forward recursion $$k = k+1;$$

the backward Kalman filtering comprises the following steps:

$$x_k^- = x_{k+1}^*;$$

$$P_k^- = P_{k+1} + Q$$

correction:

$$K_k = P_k^- e_k [e_k^T P_k^- e_k + r]^{-1}$$

$$x_k^* = x_k^- + K_k [v_k - e_k^- x_k^-]$$

$$P_k = [I - K_k e_k^T] P_k^-$$

backward recursion $$k = k - 1;$$

wherein, $x_k^{\sim}$ represents the pre-estimated state value at time point k, $x_k^*$ represents the corrected state value at time point k, $P_k^{\sim}$ represents the pre-estimated value of the covariance matrix of the estimation error $P_k$ represents the corrected value of the covariance matrix of the estimation error, Q represents the covariance matrix of disturbance $d_k$, $K_k$ represents the Kalman gain, r represents the variance of the observation noise $n_k$, I represents the unit matrix; and the estimation results of the two-way Kalman filter are the combination of estimation results of the forward Kalman filter and those of the backward Kalman filtering using the following formula:

$$P_k = (P_{k+}^{-1} + P_{k-}^{-1})^{-1},$$

$$x_k^* = P_k (P_{k+}^* + P_{k-}^{-1} x_{k-}^*),$$

wherein, $P_{k+}$, $x_{k+}$ are the estimated state value and the covariance of the estimation obtained by the forward Kalman filtering respectively, and $P_{k-}$, $x_{k-}$ represent the estimated state value and the covariance of the estimation obtained by the backward Kalman filtering respectively.

8. The speech synthesis apparatus according to claim 7, wherein the module for obtaining a DEGG/EGG signal is further configured to reconstruct a full DEGG/EGG signal using a DEGG/EGG signal of a single period based on a given fundamental frequency and time length.

* * * * *